US010781818B2

(12) United States Patent
Sadi et al.

(10) Patent No.: US 10,781,818 B2
(45) Date of Patent: Sep. 22, 2020

(54) AXIAL FAN

(71) Applicant: Ziehl-Abegg SE, Künzelsau (DE)

(72) Inventors: Omar Sadi, Schwäbisch Hall (DE); Andreas Gross, Neuenstein (DE); Lothar Ernemann, Heilbronn (DE); Frieder Lörcher, Braunsbach (DE)

(73) Assignee: Ziehl-Abegg SE, Künzelsau (DE)

( * ) Notice: Subject to any disclaimer, the term of this patent is extended or adjusted under 35 U.S.C. 154(b) by 311 days.

(21) Appl. No.: 14/383,542

(22) PCT Filed: Mar. 6, 2013

(86) PCT No.: PCT/EP2013/000649
§ 371 (c)(1),
(2) Date: Sep. 6, 2014

(87) PCT Pub. No.: WO2013/131641
PCT Pub. Date: Sep. 12, 2013

(65) Prior Publication Data

US 2015/0023791 A1 Jan. 22, 2015

(30) Foreign Application Priority Data

Mar. 6, 2012 (DE) ..... 10 2012 004 617

(51) Int. Cl.
*F04D 19/00* (2006.01)
*F04D 29/54* (2006.01)
(Continued)

(52) U.S. Cl.
CPC ..... *F04D 19/002* (2013.01); *F04D 29/384* (2013.01); *F04D 29/542* (2013.01);
(Continued)

(58) Field of Classification Search
CPC .... F04D 19/002; F04D 29/644; F04D 29/666; F04D 29/667; F04D 29/384;
(Continued)

(56) References Cited

U.S. PATENT DOCUMENTS 2,115,527 A 4/1938 Hueglin
3,580,039 A 5/1971 Heinonen
(Continued)

FOREIGN PATENT DOCUMENTS

CA 2 078 761 3/1993
CA 2078761 3/1993
(Continued)

OTHER PUBLICATIONS

Balkind d et al:. Method of Manufacture of Axial-Flow Fans; Espacenet Abstract of RU94038277—publication dated Aug. 20, 1996.

*Primary Examiner* — Patrick Hamo
*Assistant Examiner* — Chirag Jariwala
(74) *Attorney, Agent, or Firm* — Gudrun E. Huckett

(57) ABSTRACT

An axial fan has a housing and a motor with motor shaft and blower wheel attached to the motor shaft. The blower wheel has fan blades attached to a hub and provided with a leading and a trailing edge, respectively. A suspension arrangement is provided with a brace part made from flat material. The brace part connects motor and housing and has a length measured in a direction from motor to housing. The brace part is arranged on edge in an airflow direction and has a width measured in the airflow direction. The brace part has two limbs extending lengthwise in length direction of the brace part. The limbs are spaced apart from each other and delimit opposite sides of an opening formed by a punch-out
(Continued)

in the flat material and extending along some of the length. The limbs are arranged one behind the other in airflow direction.

2 Claims, 7 Drawing Sheets

(51) Int. Cl.
*F04D 29/64* (2006.01)
*F04D 29/38* (2006.01)
*F04D 29/66* (2006.01)

(52) U.S. Cl.
CPC ..... *F04D 29/644* (2013.01); *F04D 29/646* (2013.01); *F04D 29/666* (2013.01); *F04D 29/667* (2013.01); *F05D 2230/10* (2013.01); *F05D 2230/51* (2013.01); *F05D 2240/304* (2013.01); *Y10T 29/49336* (2015.01)

(58) Field of Classification Search
CPC ..... F04D 29/542; F04D 29/49336; F04D 29/646; F04D 29/164; F04D 29/325; F04D 29/668; F04D 29/60; Y10T 29/49336; F05D 2240/304; F05D 2250/182; F05D 2250/183; F05D 2250/184; F05D 2230/51; F05D 2230/10
USPC .. 417/423.15, 362, 423.14, 423.7, 321, 366, 417/410.1, 423.1; 310/67 R, 89, 91, 51
See application file for complete search history.

(56) References Cited

U.S. PATENT DOCUMENTS 4,046,489 A * 9/1977 Fairchild ..... F04D 29/325 416/169 A
4,076,197 A 2/1978 Dochterman
4,089,618 A 5/1978 Patel
4,200,257 A * 4/1980 Litch, III ..... F04D 29/282 248/604
4,482,124 A * 11/1984 Dochterman ..... F16F 15/00 248/604
4,548,548 A * 10/1985 Gray ..... F01P 5/06 123/41.49
4,657,478 A * 4/1987 LaZebnik ..... F04D 29/646 248/674
5,069,415 A * 12/1991 Mechalas ..... H02K 5/26 248/604
5,312,230 A * 5/1994 Oda ..... F04D 29/384 415/119
5,326,225 A 7/1994 Gallivan et al.
5,492,456 A * 2/1996 Knight ..... F04D 29/668 248/604
5,616,004 A * 4/1997 Alizadeh ..... F04D 29/384 415/119
6,074,182 A * 6/2000 Matson ..... F04D 25/08 417/423.14
6,190,140 B1 * 2/2001 Matson ..... F04D 25/08 417/362
7,900,351 B2 * 3/2011 Koehler ..... B23P 15/006 29/557
2003/0133815 A1 * 7/2003 Grant ..... F04D 29/646 417/423.15
2006/0210397 A1 9/2006 Eimer
2007/0201982 A1 * 8/2007 Neumeier ..... F04D 29/325 416/142
2009/0246001 A1 * 10/2009 Reuter ..... F04D 25/08 415/121.2
2011/0150662 A1 6/2011 Resh et al.
2012/0039731 A1 2/2012 Sadi et al.
2014/0140861 A1 * 5/2014 Pellenc ..... E01H 1/0809 417/44.1

FOREIGN PATENT DOCUMENTS

CN 201310495 9/2009
CN 201310495 Y * 9/2009
CN 201574949 9/2010
CN 201 687 772 12/2010
CN 201687772 12/2010
DE 19 67 320 8/1967
DE 25 29 541 1/1976
DE 27 27 119 12/1977
DE 43 26 147 A1 11/1994
DE 10 2004 017 727 11/2004
DE 10 2005 023 868 B3 7/2006
DE 10 2008 014 702 A1 9/2009
EP 0 259 061 3/1988
EP 1 016 788 A2 7/2000
GB 429 958 6/1935
GB 2 281 102 A 2/1995
GB 2281102 A * 2/1995 ..... F04D 29/646
JP S51133805 11/1976
JP S5632098 4/1981
JP 59-40600 3/1984
JP H0742983 2/1995
JP 2009-239166 10/2009
KR 20010012059 A 2/2001
RU 2296246 C1 3/2007

* cited by examiner

Fig. 7
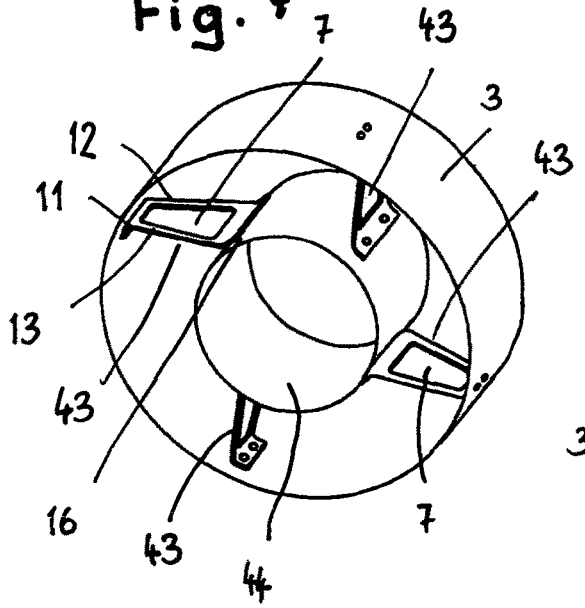
Fig. 8
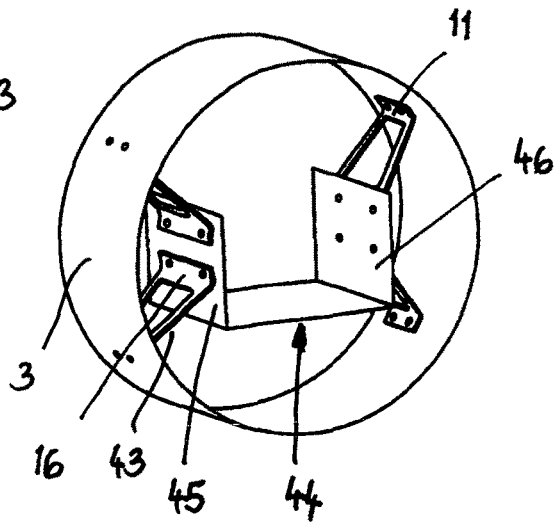
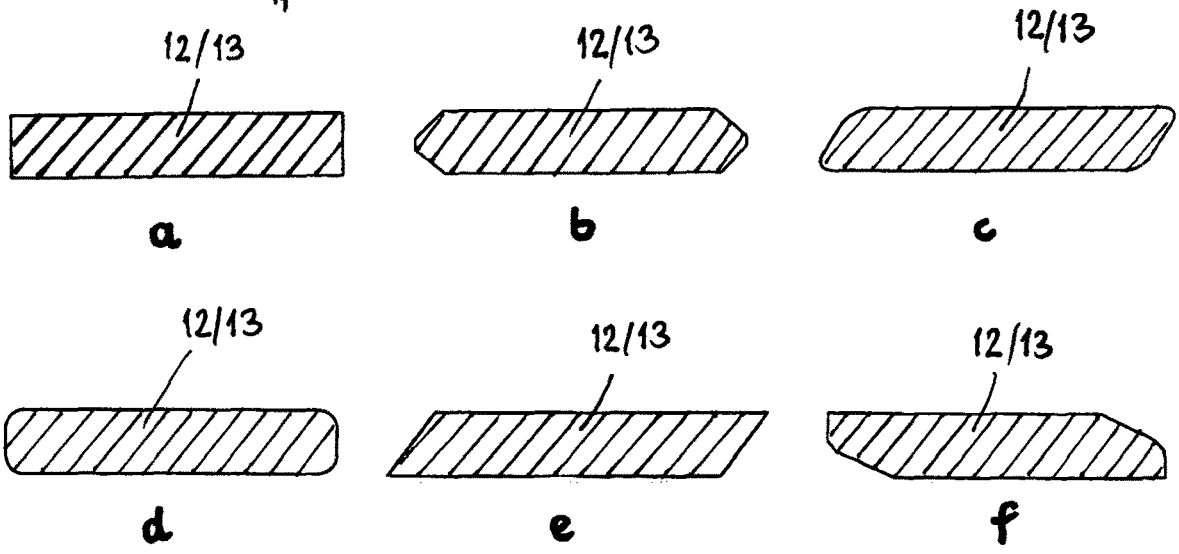
Fig. 9

AXIAL FAN

BACKGROUND OF THE INVENTION

The invention relates to an axial fan comprising a motor on which, on the rotor side, a blower wheel is attached, wherein the fan blades protrude from its hub and have a leading edge and a trailing edge, and comprising a suspension arrangement by means of which the motor is attached to a housing and which comprises at least one brace part made from flat material, which brace part connects the motor to the housing and is arranged in the direction of airflow so as to be approximately on edge. The invention further concerns a method for producing an axial fan.

Axial fans are used in a host of different applications. Although axial fans are associated with adequate overall efficiency and with little flow resistance, there are an increasing number of applications in which still more stringent requirements relating to the overall efficiency and/or the flow resistance are imposed.

Axial fans are known (DE 25 29 541 B2) in which the motor is attached to the housing by means of a suspension arrangement. The suspension arrangement is formed by radially extending braces that extend between a stator hub and the housing. In the direction of airflow the braces are arranged so as to be approximately on edge and are curved over their height. Since the braces are continuous over their length and height, the flow resistance is still too high. The braces also result in increased weight of the axial fan and contribute to noise emission during operation of the axial fan.

In another known axial fan (DE 10 2004 017 727 A1) the motor is attached to the housing by means of webs. The webs are also of a continuous design; they extend across the direction of airflow, which results in high flow resistance and a corresponding heavy weight of the axial fan as well as a loud operating noise.

Moreover, axial fans are known (DE 10 2011 015 784 A1) in which the motor is connected to the housing by way of braces that extend approximately radially. The braces are designed as discharge guide blades and are arranged approximately on edge. They are also solid throughout in design.

In another known axial fan (GB 429 958) the motor is connected to the housing by way of radially extending braces. In the connecting region to the housing the braces are wider. The braces also result in high flow resistance, in heavy weight of the axial fan, and in noisy operation of the axial fan.

Lastly, axial fans are known (EP 0 259 061 A2) in which the motor is connected to the housing by way of L-shaped braces.

It is the object of the invention to design the axial fan of the aforementioned kind in such a manner that the axial fan provides high overall efficiency and only little flow resistance. In this design the axial fan is to be of lightweight construction, economical to manufacture, and, in particular, is associated with low noise in operation.

SUMMARY OF THE INVENTION

In the axial fan of the aforementioned kind, this object is solved according to the invention in that the brace part along some of its length comprises at least one opening.

The axial fan according to the invention is characterized in that at least part of the brace part along some of its length comprises at least one opening. Because of the opening the flow resistance through the brace part is minimised. The shape and/or size and/or position of the opening can be adapted to the conditions of application of the axial fan so that depending on a particular application the optimum flow resistance can be set. The opening in the brace part results in the weight of the axial fan being kept light. The greater the number of brace parts that are used as suspension elements, the greater is the reduction in the weight of the axial fan when compared to axial fans comprising braces that are formed so as to be continuous over the length and height. Noise emission of the axial fan according to the invention is very considerably reduced because the size of separation regions associated with turbulence is greatly reduced as a result of the opening. Since in addition the brace part is arranged approximately on edge in the flowing air, through interaction with the size and/or shape and/or position of the opening the flow resistance can be kept to a minimum.

Advantageously, the brace part is formed by a sheet metal part. The use of sheet metal results in low costs of manufacture of the axial fan. If required, the sheet metal part can easily be deformed if this is necessary for installation. It can easily be installed and deinstalled. In particular, it is not necessary to weld this sheet metal part into place at its ends; instead, its ends can be screwed, riveted or similar to the corresponding components of the axial fan. When the brace part comprises sheet metal, the opening can be produced very easily by punching.

In order to achieve optimal strength of the suspension arrangement and at the same time minimal flow resistance, the limbs of the brace part, which limbs delimit the opening, are advantageously made in a width that approximately corresponds to 3 times to 15 times the thickness of the flat material, preferably to 5 times the thickness of the flat material.

Advantageously, the opening in the brace part can be formed in that a corresponding opening in the flat material is provided, which opening, in particular in the case of sheet metal, is punched out.

In a particularly advantageous design the opening in the brace part is designed in such a manner that at least one support part protrudes from an edge of the hole. It is thus possible, for example, to make a u-shaped punch-out in a piece of sheet metal, and to bend the sheet metal part situated between the edges of the punch-out from the plane of the sheet metal. In this manner the support part is formed that protrudes from the brace part, and that advantageously is integrally formed with said brace part. In this manner the brace part can comprise one or several support parts that moreover significantly improve the stability of the brace part and thus also of the entire axial fan.

Not only openings with such a transversely protruding support part, but also openings with a circumferential edge can be provided on a brace part.

The axial fan according to the invention can comprise several brace parts that can be provided in a rotationally symmetrical and/or in a mirror-symmetrical arrangement. In this manner the motor can be optimally supported on the housing.

In an advantageous embodiment a pot can be provided for accommodating the motor, on which pot the interior end of the brace part is attached.

Depending on the design of the axial fan and/or of the motor, this pot can be designed so as to be cylindrical or tubular or angular. Likewise, it is possible to design the pot so that it is u-shaped and thus does not comprise a wall all round. The motor can then be suitably mounted in the u-shaped pot. In a pot designed in this manner, too, the brace parts can easily be installed.

The axial fan according to the invention is designed in such a manner that the suspension arrangement of the motor is formed by guide vanes that in the direction of the airflow are situated downstream of the blower wheel. The motor suspension arrangement thus assumes the function of a discharge guide wheel, by means of which an additional improvement in the efficiency is achieved. This axial fan features very high overall efficiency because the fan blades at the hub of the blower wheel have a ratio of chord length to blade height in the range of approximately 0.5 to approximately 0.65, preferably of approximately 0.57. Advantageously, the guide vanes are curved over their entire height in such a manner that the flow resistance is minimal. In conjunction with the ratio of chord length to blade height the axial fan can be designed to provide very high efficiency with minimal flow resistance.

Advantageously the guide vanes extend from an interior tube of the axial fan. This interior tube is situated so as to be coaxial to the housing and is connected to the housing by means of the guide vanes.

In a preferred embodiment an attachment flange for the motor is provided in the interior tube. Said attachment flange can partly be inserted into the interior tube and can be attached to the attachment flange.

In order to achieve high efficiency it is advantageous when the fan blades are of a convoluted design.

It is advantageous when the fan blades are adjustable on an axis across the axis of rotation of the blower wheel. In this manner the step angle of the fan blades can be adjusted in order to improve efficiency.

A further improvement in the overall efficiency advantageously results when the fan blades at their free ends have a ratio of chord length to blade height in the range of approximately 0.75 to approximately 0.90, preferably of approximately 0.84.

Advantageously, the blower wheel has a hub ratio of approximately 0.2 to approximately 0.6, preferably of approximately 0.45. This hub ratio, in particular in conjunction with the ratios of chord length to blade height of the fan blades, also contributes to the high overall efficiency of the axial fan.

An advantageous embodiment results when the trailing edge of the fan blades is bionically formed. Such a design contributes to outstanding overall efficiency of the axial fan. In this manner, when compared to known axial fans, it is possible to achieve an overall efficiency that is approximately 20% greater than the overall efficiency of known axial fans. Moreover, forming the trailing edge of the fan blades bionically results in only low noise emission so that the axial fan according to the invention apart from its high overall efficiency also features low noise emission.

An advantageous embodiment results when the trailing edges of the fan blades, at least over part of their length, are wave-shaped or serrated. By means of a suitable design of the profile shape of the trailing edges it is thus possible to influence the noise emission.

Advantageously, the trailing edge of the fan blades is curved so as to be convex, and the leading edge is curved so as to be crescent-shaped.

The axial fan according to the invention is characterized in that essentially the same blade blanks are used for the fan blades. They are provided with the respective external diameter by cutting and/or provided with a contour. Thus, the blade blanks are not just cut to a particular cylindrical section, but it is also possible to give them a special contour that is attuned to the required external diameter and to the required stepped angle of the fan blades. This results in very good flexibility.

In a further embodiment, different external diameters can be achieved also in that essentially identical blade blanks are used that are attached on hub bodies of appropriate different diameters.

It is particularly advantageous when blade blanks are used that already comprise a winglet blank. From it a winglet that is optimal in terms of the particular axial fan can be produced.

The subject matter of the application results not only from the subject matter of the individual claims, but also from all the information and features disclosed in the drawings and in the description. Even if they are not the subject of the claims, they are claimed to be significant in the context of the invention to the extent that individually or in combination they are novel when compared to prior art.

Further characteristics of the invention are disclosed in the further claims, the description and the drawings.

BRIEF DESCRIPTION OF THE DRAWINGS

The invention is explained in more detail with reference to two embodiments shown in the drawings. The following are shown.

DESCRIPTION OF PREFERRED EMBODIMENTS

The axial fans according to FIGS. 1 to 4 are characterized by high efficiency and by a flow-optimised motor suspension arrangement that significantly contributes to the high efficiency. The axial fan comprises a fluidically optimised blower wheel featuring a special geometry, which is yet to be described, and high efficiency of the blower wheel. Drive motors with high motor efficiency are used in the axial fan, for example rotary-current internal rotor motors or electronically commutated external rotor motors. Furthermore, the axial fans according to FIGS. 1 to 4 are characterized by flow-optimised motor suspension arrangements.

Figure 1:
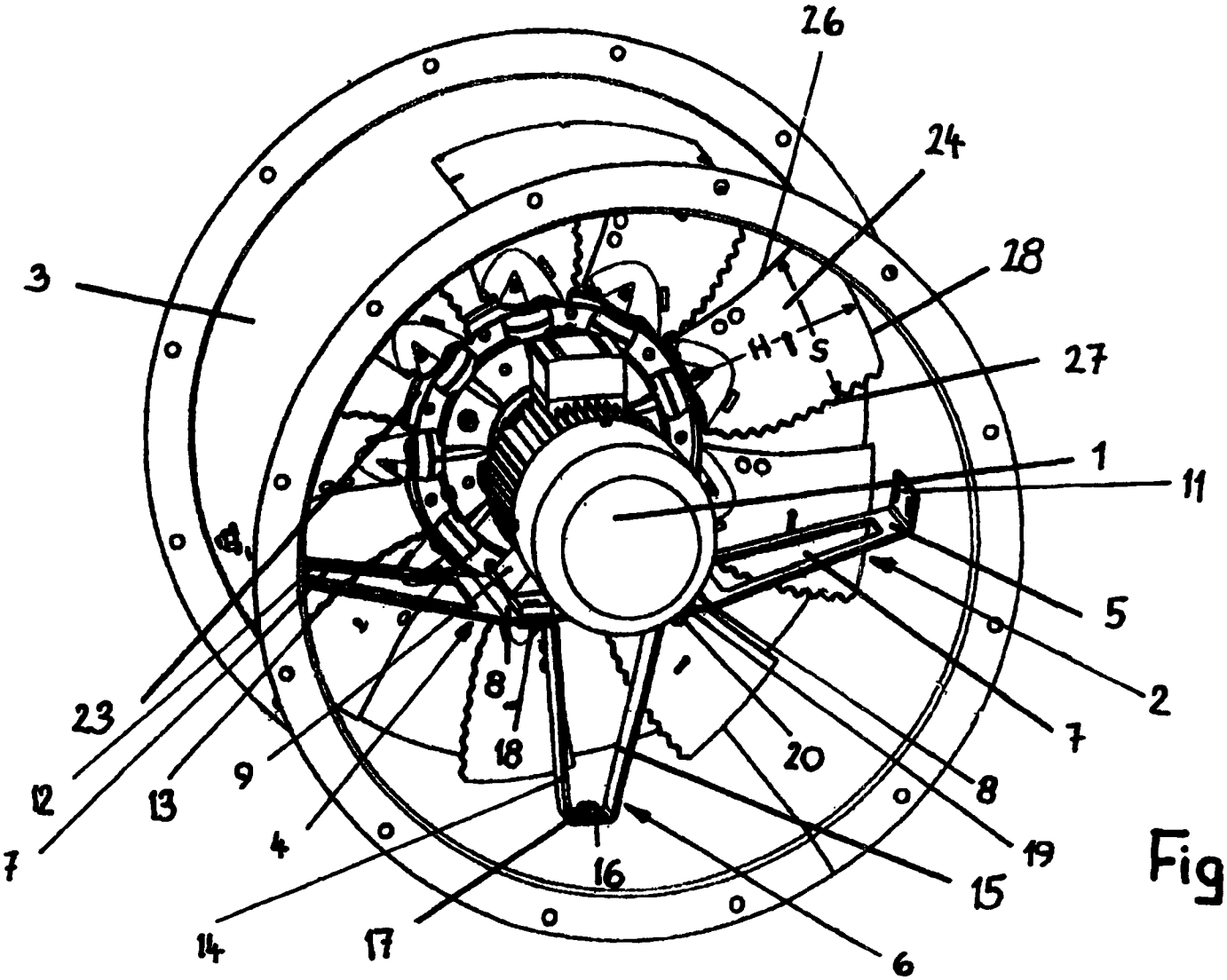
FIG. 1 a perspective view of a first embodiment of an axial fan according to the invention, FIG. 2 a lateral view of the axial fan according to FIG. 1, FIG. 3 and FIG. 4 in illustrations corresponding to those of FIGS. 1 and 2 a second embodiment of an axial fan according to the invention, FIG. 5 and FIG. 6 perspective views of further embodiments of brace parts of the axial fan according to the invention, FIG. 7 and FIG. 8 perspective views of different embodiments of mountings for the motor of the axial fan according to the invention, FIG. 9 cross sections of various designs of the openings in the brace parts delimiting limbs of the brace parts of the axial fan according to the invention, FIG. 10 various exemplary embodiments of blade blanks for manufacturing the fan blades of the axial fan according to the invention, and fan blades made thereof of the axial fan according to the invention with winglet contours.
Figure 2:
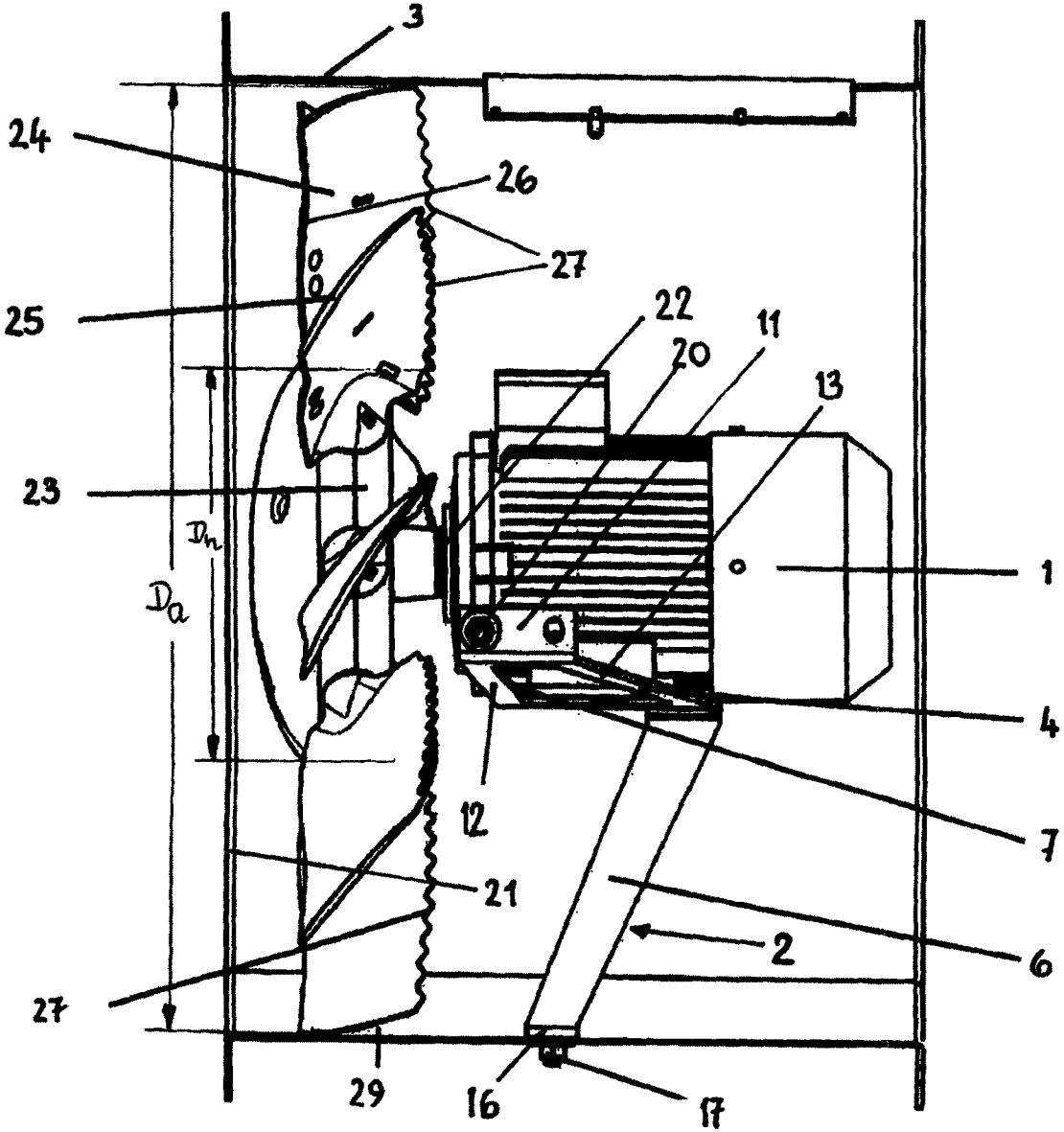

The axial fan according to FIGS. 1 and 2 comprises a motor 1 which in the exemplary embodiment shown is an internal rotor motor. The latter is held, by means of a suspension arrangement 2, on a cylindrical housing 3 that encloses the motor 1 at radial spacing. Said cylindrical housing 3 forms an outer tube of the fan and is arranged so as to be coaxial to the motor 1. As shown in FIG. 2, the motor 1 is arranged in such a manner that it does not axially protrude beyond the housing 3.

The suspension arrangement 2, which advantageously comprises sheet metal parts, is attached to the inside of the housing 3 and to the outside of the motor 1. In the exemplary embodiment shown, the suspension arrangement 2 comprises three brace parts 4 to 6 and one attachment part 8. The brace parts 4 and 5 are designed so as to be mirror-symmetrical to each other, each comprising an opening 7 that extends over a large part of its length. The brace parts 4 and 5 merge in one piece into each other by way of the attachment part 8 on the motor side, by way of which attachment part the brace parts 4, 5 are attached to a mounting block 9. The mounting block 9 is provided on the outside of the motor 1; it has a planar contact surface for the planar attachment part 8. In the exemplary embodiment the mounting block 9 is spaced apart from an axial plane of the motor 1, which axial plane extends parallel to its support surface.

The attachment part 8 extends, across the axis of the motor 1, slightly beyond the mounting block 9 (FIG. 1) from where at an obtuse angle it makes a transition to the brace parts 4, 5, which comprise the opening 7, wherein in each case the free end 11 of said brace parts 4, 5 is angled in such a manner that it can be attached so as to rest against the inner wall of the housing 3. Because of the opening 7 the brace parts 4, 5 comprise two limbs 12, 13 that are situated in one plane. The limbs 12, 13 extend in a converging manner in the direction of the free end 11. The openings 7 do not extend as far as the ends of the brace parts 4, 5, and consequently the ends of the brace parts 4, 5 are of a solid design, thus providing adequate strength in the region of the attachment on the motor 1 and on the housing 3.

Advantageously, the limbs 12, 13 have a width that approximately corresponds to 3 times to 15 times the sheet metal thickness, preferably to 5 times the sheet metal thickness. This results in optimal strength of the suspension arrangement while providing minimal flow resistance.

The support part 6 is designed so as to be approximately U-shaped; it comprises two limbs 14, 15 that converge in two directions on the housing 3, which limbs 14, 15 merge by way of a short cross piece 16. The cross piece 16 rests against the inner wall of the housing 3 and is attached in a suitable manner to said housing 3, for example by means of at least one screw 17. The cross piece 16 can also be welded to the inner wall of the housing 3.

The free ends 18, 19 of the limbs 14, 15 are angled outwards in opposite directions. As shown in FIG. 1, the free ends 18, 19 rest against the attachment part 8 of the brace parts 4, 5. Thus the attachment part 8 and the support part 6 can be attached together on the mounting block 9 of the motor 1. Attachment can take place by means of screws 20, or also by welding.

The brace parts 4 to 6 are made from flat material, preferably from sheet metal parts, wherein the sheet metal part for the brace parts 4 and 5 is bent, and for forming the openings 7 is punched. The support part 6 is bent to the described approximately U-shaped design. The sheet metal parts are arranged so as to be approximately on edge relative to the direction of airflow, and consequently they provide only little resistance to the flow. The limbs 14, 15 are arranged so as to be parallel to an axial plane of the motor 1.

The support part 6 is situated in the middle between the two brace parts 4, 5. In this manner the motor 1 is securely suspended from the housing 3. The brace parts can be manufactured very easily and economically from the sheet metal parts. The flow resistance of the brace parts 4 to 6 can be optimally adapted to a particular application by selecting the size and/or design and/or position of the openings 7 of the brace parts 4, 5. Moreover, the angle at which the brace parts 4 to 6 are arranged relative to each other can be adapted to the flow characteristics. In the example shown the brace parts 4 and 6 or 5 and 6 are arranged at angles >90° relative to each other. Depending on the required flow resistance this angle between the brace parts can be varied, for example it can be 90°, less than 90°, or significantly more than 90°. Since the limbs 12, 13 of the brace parts 4, 5 are arranged one behind the other in the direction of airflow through the housing 3, and since the limbs 14, 15 extend with their wide dimensions in the direction of the airflow, the flow resistance of the suspension arrangement 2 is minimal.

As shown in FIGS. 1 and 2, the brace parts 4 to 6 extend from the mounting block 9 of the motor 1 obliquely in the direction of the inlet end 21 of the housing 3. The attachment points of the two brace parts 4, 5 on the housing 3 are at the same height, while the cross piece 16 of the brace part 6 is spaced apart further from the inlet end 21 than are the free ends 11 of brace parts 4, 5.

A hub body 23, from which fan blades 24 protrude, is non-rotatably attached to the motor shaft 22 (FIG. 2). Said fan blades 24 are of a convoluted design and comprise a profiled cross section. Depending on the size of the axial fan a different number of fan blades 24 are provided on the hub body 23. For example, 3 to 15 fan blades 24 can be provided that are circumferentially arranged on the hub body 23, either evenly or unevenly distributed. As shown in FIG. 2, the fan blades 24 have a profile 25 that resembles that of the wing profile of an aircraft.

The hub body 23 and the fan blades 24 attached to it advantageously comprise different materials. Thus it is advantageous when the hub body 23 is an aluminium casting that is of a lightweight construction and economical to manufacture. The fan blades 24 advantageously comprise a fibre-reinforced plastic material so that economical manufacture is also possible. In this arrangement the fan blades 24 are of a lightweight and high-strength construction. In order to be able to set the step angle of the fan blades 24 the fan blades 24 are provided, in the known manner, on the hub body 23 so as to be pivotable on axes situated across, preferably perpendicular to, the axis of rotation of the blower wheel 23, 24.

The fan blades 24 have a concave curved leading edge 26 and a convex curved trailing edge 27. In order to minimise noise emission during operation of the axial fan, the trailing edge 27 is designed according to the law of bionics. Thus the trailing edge 27 can be undulating or, as shown in the exemplary embodiment, serrated. Such a profile shape of the trailing edge 27 is advantageously provided along the entire length.

The profile 25 of the fan blade 24 is designed in such a manner that the fan blade in the region of the trailing edge 27 essentially ends in a point while the profile 25 in the region of the leading edge 26 is rounded. Such a profile design is advantageously provided along the entire length of the fan blade 24.

At their radially outward edge 28 the fan blades 24 comprise a cylindrical section, irrespective of the step angle selected in the particular case. Consequently, when viewed in the direction of the axis of the fan, the edges 28 are situated on a common cylinder surface whose axis coincides with the axis of rotation of the hub body 23. In this manner the air gap 29 between the outer edge 28 of the fan blades 24 and the inner wall of the housing 3 can be set in such a manner that optimum flow capacity with minimum noise emission is achieved. The described cylindrical section can be carried out by subsequent machining on the already assembled blower wheel 23, 24, for example by milling or sawing of the fan blades 24. Consequently, the air gap geometry can be optimised easily and reliably. In this manner the air gap 29 can be set to be very small so that leakage flow is very small.

In one embodiment (not shown) the fan blades 24 comprise a winglet on the outer edge 28. With the use of such fan blades the airflow through the air gap 29 can be further reduced, because together with a narrow air gap 29 they form considerable resistance to any leakage flow around the outer edge 28. The winglets can be produced by machining the fan blades 24 on the outer edge 28. To this effect the fan blades 24 are machined in such a manner that the respective winglet is created on the edge 28. Such machining is carried out in such a manner that a rounded transition is formed from the pressure side to the suction side of the fan blades 24. The winglets can be provided on the suction side and/or on the pressure side of the fan blades 24.

The motor 1 and the blower wheel 23, 24 are situated within the cylindrical housing 3. By way of the suspension arrangement 2 the motor 1 with the blower wheel 23, 24 is reliably held on the housing 3. Because of the described design of the brace parts 4 to 6 the suspension arrangement 2 offers only minimal flow resistance. In conjunction with the described design of the fan blades 24, which design results in high efficiency of the blower wheel, an axial fan results that features great overall efficiency.

The fact that the hub ratio $D_a/D_n$ of the blower wheel 23, 24 ranges from approximately 0.2 to approximately 0.6, and preferably is approximately 0.45, contributes to the high overall efficiency. $D_a$ denotes the external diameter of the blower wheel, and $D_n$ denotes the hub diameter.

On the hub 23 the fan blades 24 have a ratio of chord length S to blade height H in the range of approximately 0.5 to approximately 0.65, preferably of approximately 0.57, and on the free end a ratio of approximately 0.75 to approximately 0.90, preferably of approximately 0.84.

Figure 3:
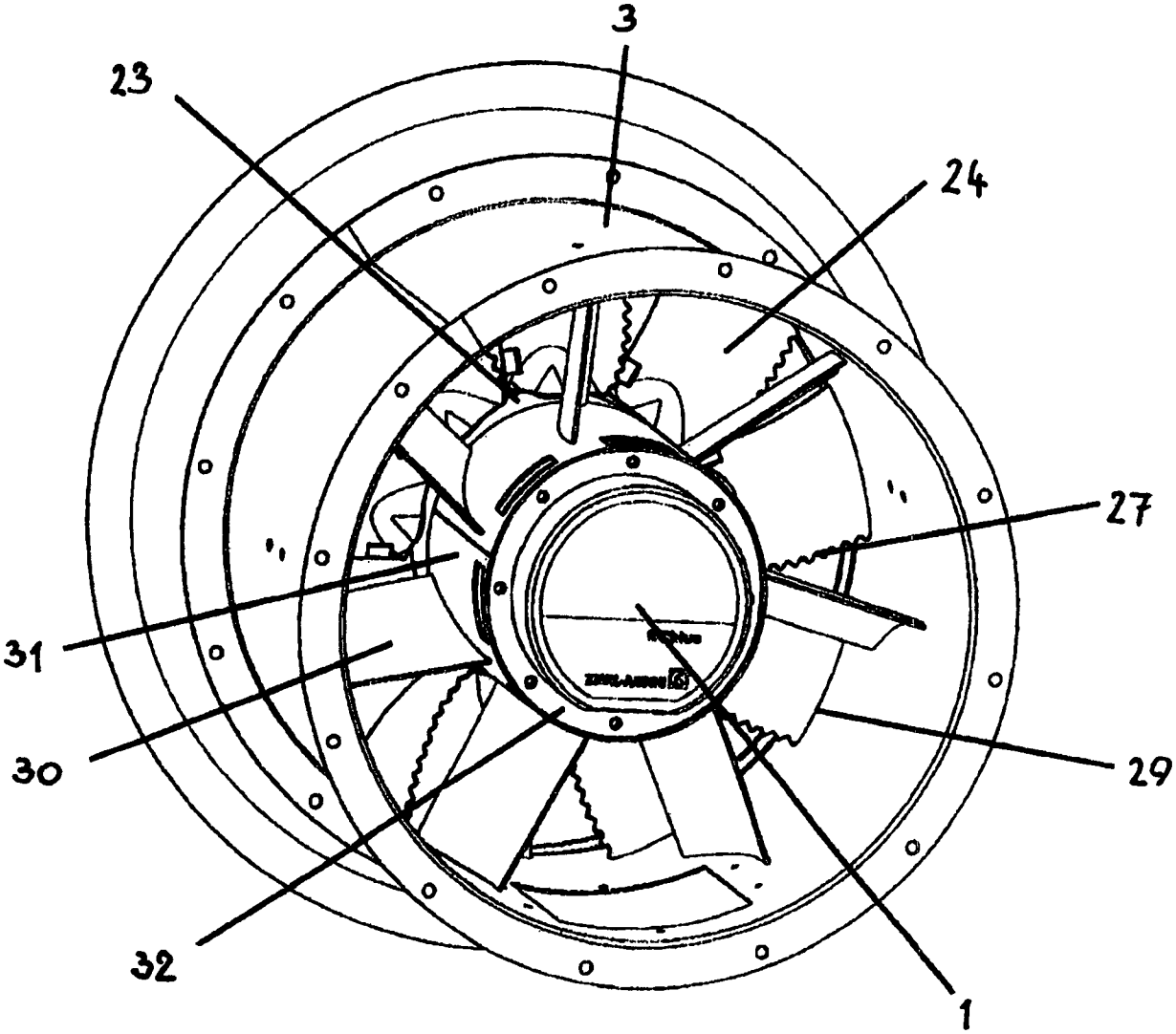
Figure 4:
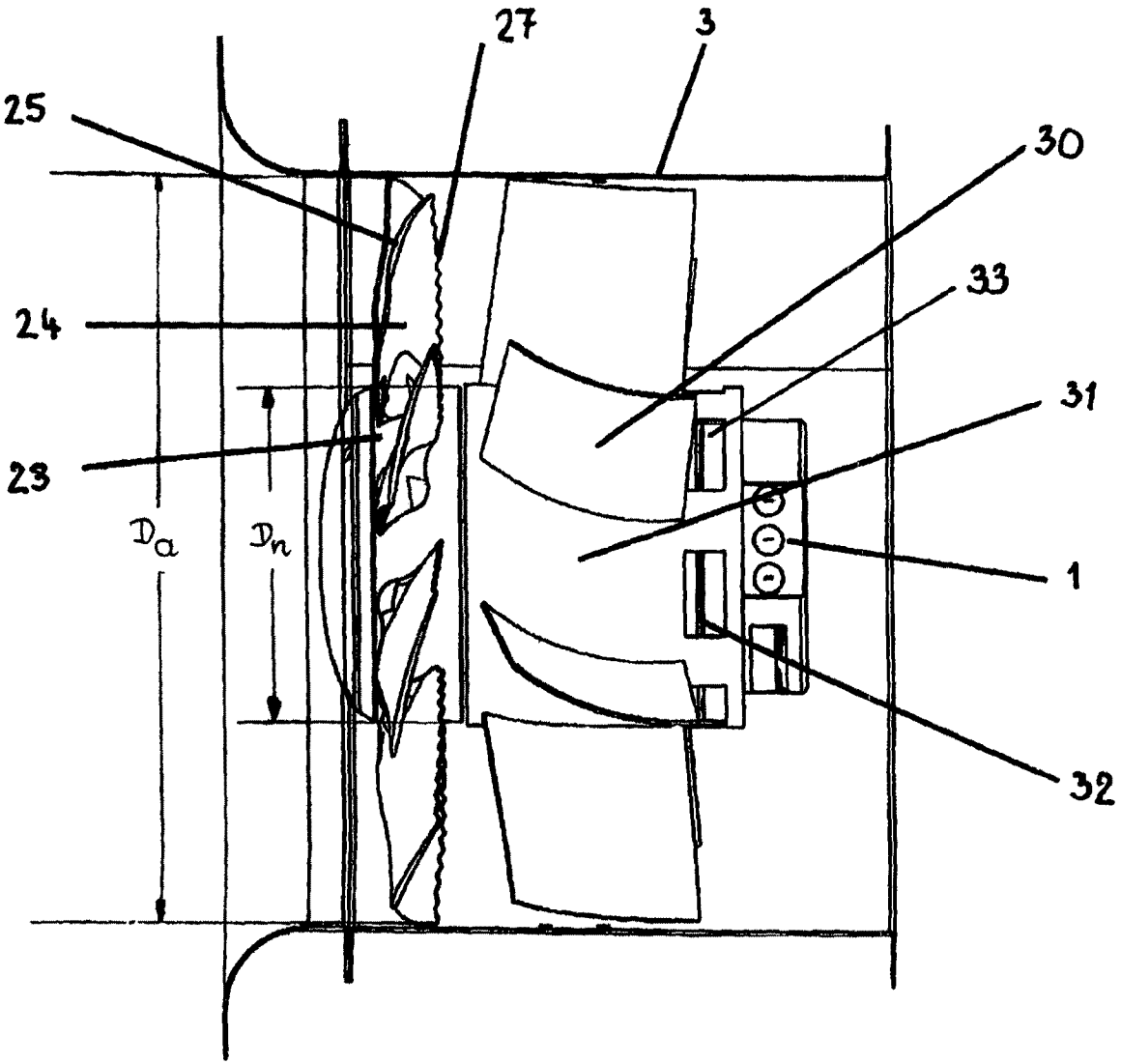

In the embodiment according to FIGS. 3 and 4 the fan blades 24 are designed and arranged on the hub body 23 in the same manner as in the previous embodiment. Advantageously, for adjustment of the step angles, the fan blades 24 are adjustably connected to the hub body 23. The fan blades 24 comprise the profiled trailing edge 27 and the profile 25 that is designed in accordance with the previous embodiment.

The suspension arrangement of the motor 1 is formed by discharge guide vanes 30 that are provided in the direction of flow of the conveyed air with axial spacing downstream of the blower wheel 23, 24. Advantageously, the discharge guide vanes 30 comprise sheet metal; however, they can also be manufactured from correspondingly rigid plastic. The discharge guide vanes 30 extend between the housing 3 and an interior tube 31 that is arranged so as to be coaxial to the housing 3. The guide vanes 30 are suitably attached, for example welded or screwed, to the inside of the housing 3 and to the outside of the tube 31. The number of discharge guide vanes 30 depends on the size of the axial fan. For example, 3 to 25 such discharge guide vanes can be provided. In the exemplary embodiment shown there are 7 discharge guide vanes 30 that form the motor suspension arrangement.

Within the tube 31 an annular flange 32 is attached that is designed as a flat ring to which the motor 1 can be attached. At the motor end the tube 31 is open so that for attachment to the annular flange 32 the motor 1 can be inserted in the tube 31. The motor 1 advantageously comprises a counter flange that comes to rest against the annular flange 32 and is suitably connected to it, preferably with the use of screws. The motor 1 can, for example, be a flange motor or an EC-external rotor motor to whose motor shaft the blower wheel 23, 24 is non-rotatably attached.

Advantageously, the discharge guide vanes 30 are gradually curved over their width. The curvature is selected in such a manner that high efficiency is achieved. In conjunction with the design of the blower wheel 23, 24, which design has been described in the context of FIGS. 1 and 2, high overall efficiency results, wherein noise emission during operation is minimal.

When the discharge guide vanes 30 comprise sheet metal, they can be manufactured economically essentially by being cut out and rolled.

In order to achieve good cooling of the motor 1 the tube 31 comprises circumferentially arranged openings 33 at the height of the annular flange 32.

For the remainder, the blower wheel 23, 24 is designed in the same manner as the blower wheel of the previous embodiment, so that reference is made to the description of said embodiment.

The described axial fans can be manufactured in a host of different design sizes. As an example, the internal diameter of the housing 3 can be in a range of approximately 200 mm to approximately 1,800 mm.

When the fan blades 24 in the preferred manner comprise the described plastic material, it is possible, for manufacturing the fan blades 24, to use only one single injection mould for the various design sizes of the fan. The injection mould is tailored to the longest length of the fan blades 24. When shorter fan blades 24 are required, they are cut to the required length. The same also applies to fan blades 24 made from cast metal.

Figure 5:
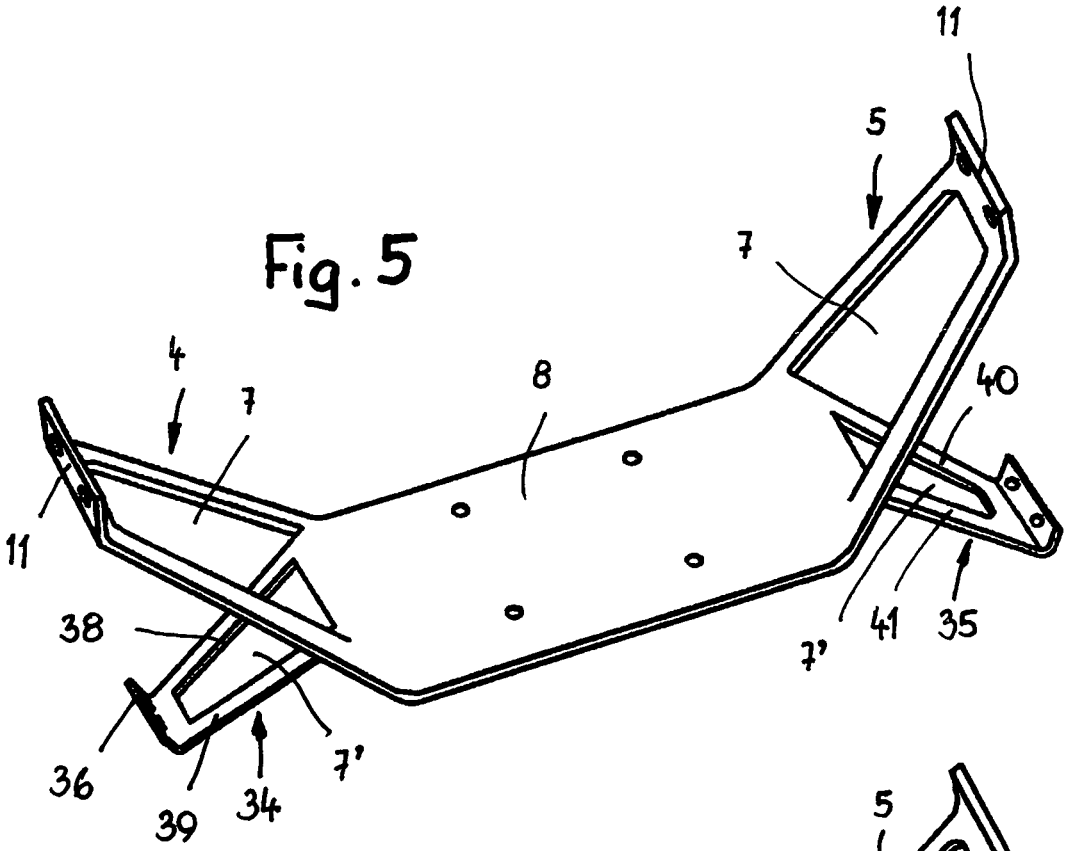

FIG. 5 shows the two brace parts 4, 5 that are interconnected by way of the attachment part 8. Each of the brace parts 4, 5 has an opening 7. In contrast to the previous embodiments these openings do not have a circumferential edge. Instead, on the edge adjacent to the attachment part 8 a support part 34, 35 has been bent out transversely, with each support part 34, 35 comprising an opening 7'. The support parts 34, 35 and the parts of the brace parts 4, 5 that comprise the openings 7 extend obliquely to each other so that in each case they encompass an angle with the planar attachment part 8. The free ends 36, 37 of the support parts 34, 35 are angled in the same direction as the free ends 11 of the brace parts 4, 5. The angular arrangement 11, 36, 37 is selected so that the brace parts 4, 5 and the support parts 34, 35 can be reliably attached, resting against the inner wall of the housing 3. In the exemplary embodiment the angular arrangements comprise two through-openings for attachment screws or the like.

The angular arrangements 36, 37 can also point in a direction that differs from the direction of the angular arrangements 11 of the brace parts 4, 5.

The openings 7' are likewise delimited by two limbs 38, 39; 40, 41 that extend so as to converge in the direction of the free end 36, 37. The openings 7' end at some distance from the attachment part 8 and also from the free ends 36, 37.

Similar embodiments that do not comprise an additional opening 7' are also conceivable.

The support parts 34, 35 are manufactured in that an approximately u-shaped punching is made in the brace parts 4, 5 in such a manner that the support parts 34, 35 can be bent out into the position shown in FIG. 5.

The brace parts 4, 5, the attachment part 8 and the support parts 34, 35 are advantageously made in one piece; they comprise sheet metal material. This allows simple and economical manufacture. Because of the additional support elements 34, 35, when compared to the previous exemplary embodiments, the stability of the suspension arrangement is considerably improved. Furthermore, still more secure attachment of the motor 1 to the housing 3 is ensured. The brace parts 4, 5, the attachment part 8 and the support parts 34, 35 can easily be installed and deinstalled, for example by means of screws or rivets. These components do not have to be welded, and consequently there is no need for an expensive welding procedure.

In terms of their size and/or shape and/or position the openings 7, 7' can be provided such that the flow resistance of the air becomes minimal. Since the suspension arrangement comprises flat material in the manner described and comprises the openings 7, 7', the suspension arrangement is of a lightweight design despite its good stability.

Figure 6:
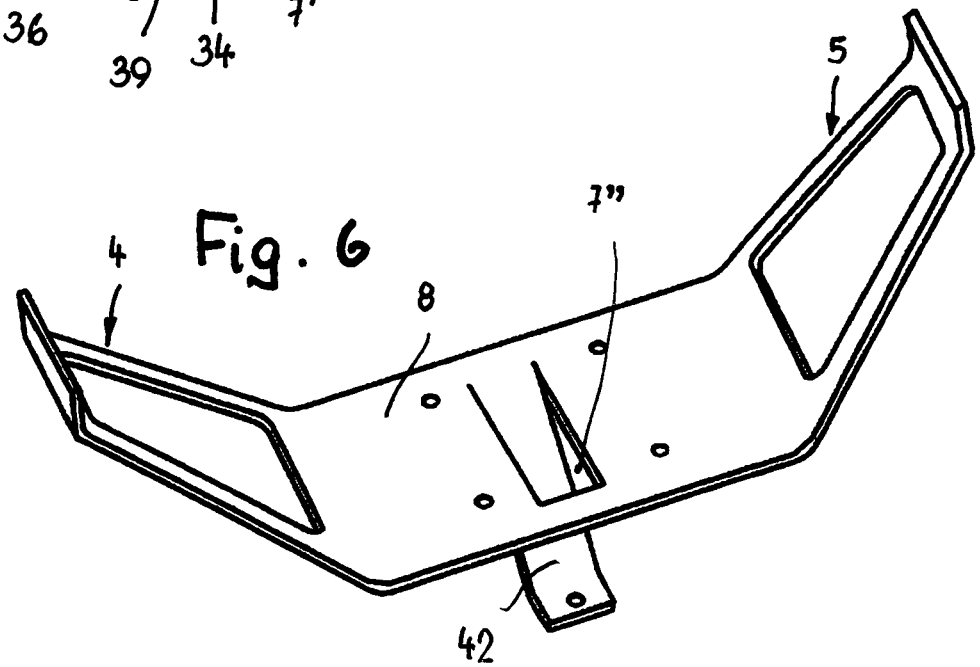

FIG. 6 shows a further option of designing the suspension arrangement. The two brace parts 4, 5 are of the same design as in the previous exemplary embodiment. As an example, the attachment part 8 comprises a bent-out tab 42 at mid-length, with the free end of said tab 42, for example, comprising a through-opening for an attachment screw or the like. The free end is angled so that it can be installed at the required position within the axial fan.

Because of the bent-out tab 42 the attachment part comprises an opening 7". As is the case in the previous exemplary embodiments, the two brace parts 4, 5 extend, diverging, from the attachment part 8 over the same side of the attachment part. The tab 42 extends obliquely over the other side of the attachment part 8.

FIGS. 5 and 6 merely show exemplary embodiments in terms of the design of the brace parts with the openings. These exemplary embodiments are not to be interpreted to be limiting in any way.

FIG. 7 diagrammatically shows that the housing 3 can be connected, by way of several brace parts 43, to a pot 44 in which the motor 1 is accommodated. The pot 44 is cylindrical in design and is situated so as to be coaxial to the housing 3. The braces 43 are of an identical design, each comprising the opening 7 that is delimited by the limbs 12, 13 which extend radially outwards in a converging manner. The radially outer and the radially inner ends 11, 16 are angled in such a manner that the brace parts 43 can be attached to the inner wall of the housing 3 and to the outer wall of the pot 44. The brace parts 43 are arranged on edge, as is the case in the previous exemplary embodiments.

As is shown as an example in FIG. 8, the pot 44 can also comprise a u-shaped design. The brace parts 43 are attached to the limbs 45, 46 of the pot 44, which limbs 45, 46 are arranged so as to be parallel to each other. The brace parts 43 are of an identical design to that of the embodiment according to FIG. 7. Their radially outer end 11 is attached to the inside of the housing 3, and their radially inner end 16 is attached to the outsides of the limbs 45, 46 of the pot 44, which outsides face away from each other. The motor 1 (not shown) is supported by the u-shaped pot 44.

Moreover, the pot 44 can also comprise an angular shape and can completely encase the motor, as is the case in the exemplary embodiment according to FIG. 7.

FIGS. 7 and 8 show that the brace parts 43 are advantageously arranged so as to be rotationally symmetrical and/or mirror-symmetrical to each other.

FIG. 9 shows various possible designs of the cross sections of the limbs 12, 13, 38 to 41 of the brace parts 4, 5, 34, 35, 43. By transversely cutting and rounding or chamfering the cutting edges, the opening 7 can be designed in such a manner that noise emission is minimal.

FIG. 9*a* shows a rectangular cross section as is obtained initially during punching or laser cutting. The cutting edges are sharp, and the cutting surfaces are approximately perpendicular to the surfaces of the flat material.

In the cross section of FIG. 9*d* all the edges are rounded. This can result in a significant reduction in noise emission because the sharp edge has been eliminated. It is also possible for only some of the edges of the cross sections to be rounded.

In an embodiment with a cross section according to FIG. 9*b* a similar effect is achieved as in the embodiment according to FIG. 9*d*. In the exemplary embodiment according to FIG. 9*b* the edge is chamfered.

In the embodiment according to FIG. 9*e* acoustic and aerodynamic advantages are achieved in that the cut is not made so as to be perpendicular to the surface of the flat material, but instead obliquely to it. The alignment of the cut surface can better be adapted to the direction of flow than is the case in a cut made perpendicularly to the surface of the flat material.

In particularly advantageous embodiments according to FIGS. 9*c* and 9*f* the design options of oblique cutting according to FIG. 9*e* and of rounding or incorporating a chamfer are combined in order to obtain optimal acoustic characteristics.

In conjunction with the particular design of the openings, it is also possible to optimise the cross sections of the limbs of the brace parts and of the support parts, which limbs delimit the openings, in such a manner that the flow resistance and noise emission are minimal. The openings and the limbs can be attuned to each other in such a manner that, depending on the particular application of the axial fan, optimally low flow resistance and noise values are achieved. In conjunction with the described ratio of width to thickness of the limbs of the brace parts and of the support parts, which limbs delimit the opening, in the range of approximately 3 to approximately 15, thus minimum flow resistance and minimum noise emission result at optimum strength of the suspension arrangement.

As already described, advantageously it is possible to set the step angle of the fan blades 24 in that said fan blades 24 are provided to be correspondingly adjustable on the hub body 23.

In addition to the aforesaid, or instead of these adjustable blades, in an advantageous design different external diameters can be achieved from essentially identical blanks in that the blanks are cut to various external diameters. These blanks can be castings that initially are manufactured identically and that are then adapted to the particular external diameter required.

Additionally or alternatively it is possible to implement various external diameters of the fan blades 24 in that essentially identical individual blade blanks are installed on hub bodies of different diameters and, if necessary, are cut in terms of the external diameter or are subsequently machined.

When the fan blades 24 comprise a winglet on the radially outer edge 28, the aforesaid can also be made from the blanks. It is not possible for the winglets themselves to be provided in the mould, because their geometry or their position depends on the external diameter of the blower wheel and on the stepped angle. It is thus advantageous when the blade blanks are not only cut in a cylindrical cut, as described above, but are given a special contour, in particular by way of machining, or in the case of plastics possibly by thermoforming, which special contour can be attuned to the particular external diameter and the particular stepped angle. This results in very good flexibility during construction or installation of the particular fan. Thus, optimum acoustic characteristics of the fan blades and thus of the fan are achievable for every external diameter and stepped angle.

Figure 10:
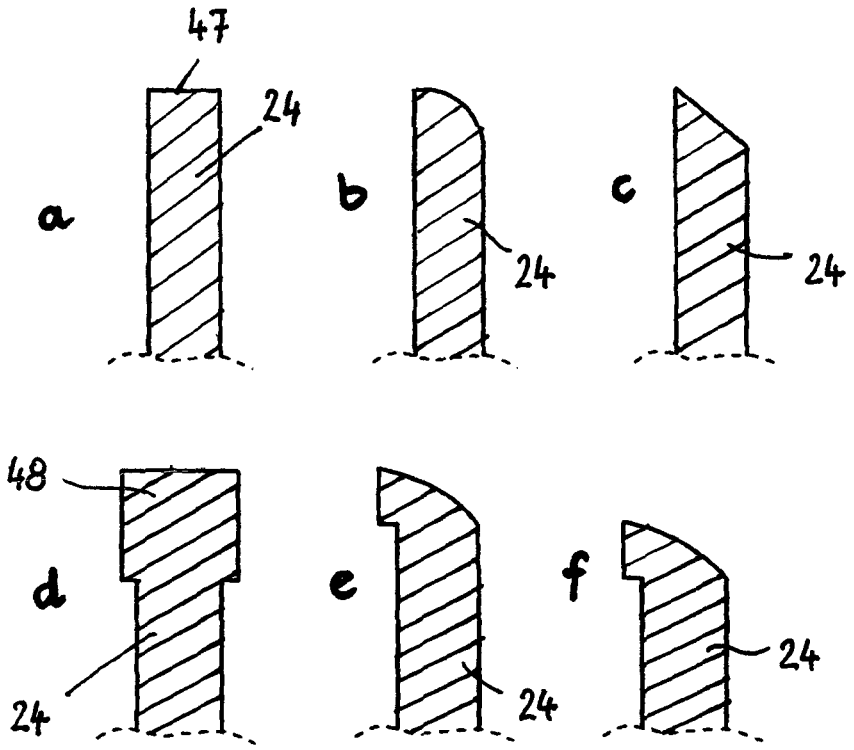

FIGS. 10*a* and 10*d* show exemplary options, in section view approximately perpendicularly to the surface of the blade suction side or blade pressure side, relating to the design of a single blank of a fan blade. In the exemplary embodiment according to FIG. 10*a* the blank 24 is rectangular in shape with parallel longitudinal sides and a narrow end 47 that extends at a right angle to the aforesaid. This shape results in particular when, in the design of the original blade casting tool or mould, the design of a winglet was not yet provided for.

In the exemplary embodiment of a blade blank according to FIG. 10*d*, a winglet blank 48, which is a thickening or accumulation of material, is already provided in the wing tip region, from which winglet blank the final winglet, adjusted to the actual stepped angle and to the external diameter, is created. In this exemplary embodiment the winglet blank 48 comprises a rectangular cross section; however, in principle it may have any desired cross section.

FIGS. 10*b* and 10*c* diagrammatically show two embodiments of winglets that have been created by subsequent machining of a blank according to FIG. 10*a*. The embodiment according to FIG. 10*c* has a cross-sectional contour of the winglet that is straight, in contrast to the embodiment according to FIG. 10*b* that has a rounded contour. However, both winglets can be produced from identical blade blanks. Furthermore, any other forms are conceivable, provided they can be manufactured from a blade blank like the blank according to FIG. 10*a*. The scope and nature of the invention consists in particular of manufacturing winglets, optimally adapted to any desired external diameters and at any desired stepped angles, in a subsequent process step from a blank. It is, furthermore, possible to manufacture, from a blank, winglets of different contours, which winglets are optimally adapted to the particular flow conditions.

FIGS. 10*e* and 10*f* show cross sections of winglets, analogous to those of the previous description of FIGS. 10*b* and 10*c*, which winglets were created from a blank according to FIG. 10*d*. FIG. 10*f* shows a fan blade of shorter length (smaller external diameter) but of a similar winglet contour as the fan blades according to FIG. 10*e*. Both fan blades can be made from an identical blank.

The winglet blank 48 in the blank according to FIG. 19*d* provides an advantage in that more design options relating to the winglet are available. However, in order to implement these additional design options, a winglet blank 48 in the mould of the blade is provided right from the start.

The design of the gradient of the winglet contour in the longitudinal direction of the blade can be freely selected. The only decisive factor consists of all the winglets to be realised being geometrically within the contour of the associated blank, according to the external diameters and stepped angles. The winglets are added in an additional process step following casting or moulding of the blanks.

The described design of the blanks for the fan blades and the winglets applies irrespective as to whether the fans comprise the suspension arrangement or the special conditions of the described fan blade geometries described with reference to FIGS. 1 to 9. With the use of the blanks, the fan blades (with or without winglets) can be optimally attuned to the respective fan, in particular also to the respective external diameter of the blower wheel and to the stepped angle, and consequently the optimum design of the respective fan can be achieved from the blanks.

Furthermore, it is possible for the blade blanks to already comprise winglet blanks which subsequently can be optimally adjusted to the respective application by corresponding machining. In principle the winglet shape of a blank can be of any design.

The invention claimed is:

1. A method for manufacturing an axial fan, the axial fan comprising:

a cylindrical housing;

a motor arranged in and surrounded by the cylindrical housing, wherein the motor comprises a motor shaft;

a blower wheel attached to the motor shaft;

the blower wheel comprising a hub and fan blades attached to the hub;

the fan blades comprising a leading edge and a trailing edge, respectively;

a suspension arrangement comprising at least one brace part that is a flat sheet metal part;

the at least one brace part comprising a first end, positioned radially outwardly and directly connected to a cylindrical inner wall of the cylindrical housing, and further comprising a second end, opposite the first end and directly connected to an outside of a motor housing of the motor, so that the motor is connected to the cylindrical housing by the at least one brace part, wherein the at least one brace part has a length and said length is measured from the motor housing of the motor to the cylindrical housing;

the at least one brace part arranged axially at a level of the motor housing and arranged in a direction of airflow through the cylindrical housing so as to be positioned edgeways and having a width measured in the direction of airflow;

the at least one brace part comprising two limbs extending lengthwise in a direction of said length of the at least one brace part from the first end to the second end, wherein the two limbs are spaced apart from each other and delimit opposite sides of at least one opening formed by a punch-out in the flat sheet metal part and extending along most of said length, wherein the two limbs are arranged one behind the other in the direction of airflow, wherein the at least one opening extending along most of said length reduces noise emission and flow resistance of the axial fan;

wherein the method comprises:

producing by casting in a mould identical castings as blade blanks;

cutting the blade blanks by a cylindrical cut to a desired external diameter of the blower wheel;

imparting by cutting a final contour of a fan blade to the blade blanks, wherein the final contour is matched to the external diameter and a stepped angle of the fan blades.

2. A method for manufacturing an axial fan, the axial fan comprising:

a cylindrical housing;

a motor arranged in and surrounded by the cylindrical housing, wherein the motor comprises a motor shaft;

a blower wheel attached to the motor shaft;

the blower wheel comprising a hub and fan blades attached to the hub;

the fan blades comprising a leading edge and a trailing edge, respectively;

a suspension arrangement comprising at least one brace part that is a flat sheet metal part;

the at least one brace part comprising a first end, positioned radially outwardly and directly connected to a cylindrical inner wall of the cylindrical housing, and further comprising a second end, opposite the first end and directly connected to an outside of a motor housing of the motor, so that the motor is connected to the cylindrical housing by the at least one brace part, wherein the at least one brace part has a length and said length is measured from the motor housing of the motor to the cylindrical housing;

the at least one brace part arranged axially at a level of the motor housing and arranged in a direction of airflow through the cylindrical housing so as to be positioned edgeways and having a width measured in the direction of airflow;

the at least one brace part comprising two limbs extending lengthwise in a direction of said length of the at least one brace part from the first end to the second end, wherein the two limbs are spaced apart from each other and delimit opposite sides of at least one opening formed by a punch-out in the flat sheet metal part and extending along most of said length, wherein the two limbs are arranged one behind the other in the direction of airflow, wherein the at least one opening extending along most of said length reduces noise emission and flow resistance of the axial fan;

wherein the method comprises:

producing by casting in a mould a blade blank that comprises a material accumulation as a winglet blank in an area of a wing tip of a fan blade to be produced from the blade blank, wherein the material accumulation is thicker than a remaining blade blank body of the blade blank;

machining or processing the winglet from the winglet blank and matching the winglet to an external diameter and a stepped angle of the fan blade.

* * * * *